United States Patent [19]

Rogers

[11] Patent Number: 4,753,391

[45] Date of Patent: Jun. 28, 1988

[54] APPARATUS FOR ENHANCING THE PERFORMANCE OF A SPRINKLER ASSEMBLY OR THE LIKE

[75] Inventor: William H. Rogers, Fresno, Calif.

[73] Assignee: Weather Tec Corp., Calif.

[21] Appl. No.: 88,551

[22] Filed: Aug. 24, 1987

[51] Int. Cl.[4] ..... B05B 15/10

[52] U.S. Cl. ..... 239/203; 239/205; 239/206

[58] Field of Search ..... 239/203–206, 239/264, 456, 459; 92/77

[56] References Cited

U.S. PATENT DOCUMENTS 4,479,611 10/1984 Galvis ..... 239/205

FOREIGN PATENT DOCUMENTS 972006 7/1975 Canada ..... 239/204

*Primary Examiner*—Andres Kashnikow
*Assistant Examiner*—Mary Beth Jones
*Attorney, Agent, or Firm*—Worrel & Worrel

[57] ABSTRACT

Apparatus for enhancing the performance of a sprinkler assembly or the like, the apparatus having a frame slidably mounted on the sprinkler assembly. The frame mounts a spring-biased plunger which is operable, selectively, to release fluid to the sprinkler assembly when the sprinkler assembly is deployed at a predetermined attitude above the surface of the earth.

11 Claims, 4 Drawing Sheets

APPARATUS FOR ENHANCING THE PERFORMANCE OF A SPRINKLER ASSEMBLY OR THE LIKE

BACKGROUND OF THE INVENTION

1. Field of the Invention

The present invention relates to an apparatus for enhancing the performance of a sprinkler assembly or the like, and more particularly to such an apparatus that is relatively inexpensive to construct and maintain, and which includes a frame having a plunger sealably engageable with a spring-biased sleeve which mounts a sprinkler head, the plunger selectively occluding the spring-biased sleeve during movement of the sleeve to a deployed position but being urged to a non-occluding position to release fluid to the sprinkler head when the sprinkler head has reached a predetermined deployed position.

2. Description of the Prior Art

Rotary pop-up sprinklers of various configurations, capacities, and other operational characteristics have been known and utilized for many years. In its most common form, the sprinkler is mounted internally of a casing which is buried in the earth. The sprinkler mounts a lid which is adapted to seal the casing, and provides a supporting surface which enables individuals to cut the surrounding lawn, walk over the device, and generally use the lawn in an unrestricted manner. When the sprinkler is in use, the sprinkler is urged upwardly above the surface of the ground, by water pressure, to permit ejection of the water onto the surrounding areas in accordance with the predetermined irrigation pattern of the sprinkler.

While it is well understood that the utilization of these prior art sprinkler assemblies achieves numerous laudable results, the devices, however, suffer from a multiplicity of common drawbacks which have detracted from their usefulness. For example, nearly all the prior art devices employ, in one form or another, a spring-biased sleeve which mounts a sprinkler head. The spring-biased sleeve is urged, under fluid pressure, to move from a position of rest inside the casing to a deployed position wherein the sprinkler head is positioned in a predetermined attitude above the surface of the earth. While this arrangement usually works with some degree of success, the prior art devices have a common shortcoming in that they frequently do not deploy to a fully extended position because the spring-biased sleeve becomes partially inoperative after it is exposed for prolonged periods of time to dirt or other debris.

Furthermore, the devices frequently do not positively retract substantially internally of their casings when irrigation operations cease. This is due in part to the previously described problem of contamination interfering with the spring-biased sleeve, and it is also due in part to the presence of a weak or old retraction spring which may not cause the sprinkler to retract positively back into the casing. It should be appreciated, of course, that the retraction spring must have sufficient strength to urge the sprinkler back to the position of rest inside the casing, but must also be weak enough such that it can be placed into compression by the water pressure utilized in the sprinkler system. The failure of the sprinkler to retract positively into the casing can produce undesirable results such as being struck and damaged by lawn mowers and the like. Similarly, they may constitute a hazard to people passing through the area in that people may trip over them, or fall into them.

Still another significant problem associated with the prior art assemblies results from characteristics inherent in their design. Prior art devices begin expelling water as soon as water pressure is applied to the sprinkler system, that is, the sprinkler heads begin delivering water even before the sprinkler head is out of the casing and deployed in a proper attitude above the surface of the earth. Under normal operating conditions, the amount of water released inside the casing is usually quite small. However, when one of these prior art devices fail to deploy due to one of the previously described problems, the casing rapidly fills with water and the surrounding area can become flooded, thus causing damage to the lawn or areas adjacent thereto.

Therefore, it has long been known that it would be desirable to have an apparatus for enhancing the performance of a sprinkler assembly or the like, which operates to insure full extension and full retraction of the sprinkler assembly as intended during operation, which is adapted to a wide variety of pop-up type sprinkler assemblies, which is adapted to be constructed as an operable part of a sprinkler assembly during manufacture or retrofitted on existing sprinkler assemblies, and which is operable selectively to release fluid to the sprinkler assembly when the sprinkler assembly reaches a predetermined position above the surface of the earth.

SUMMARY OF THE INVENTION

Therefore, it is an object of the present invention to provide an improved apparatus for enhancing the performance of a sprinkler assembly or the like.

Another object is to provide such an apparatus which is operable to insure that a sprinkler assembly on which it is installed is deployed in its fully extended and, conversely, fully retracted position.

Another object is to provide such an apparatus which is operable only to release fluid to a sprinkler assembly when it is disposed in a predetermined attitude above the surface of the earth.

Another object is to provide such an apparatus which can be constructed as an operable part of sprinkler assemblies at the time of manufacture or can be retrofitted on most models and designs of commercially available pop-up sprinkler assemblies.

Another object is to provide such an apparatus which is easily mounted on a sprinkler assembly and which further is easily accessed for purposes of maintenance, modification, or the like.

Another object is to provide such an apparatus which is characterized by ease of installation, simplicity of construction, and which can be sold and maintained at relatively nominal expense.

Another object is to provide such an apparatus which is operable to obtain the individual benefits to be derived from prior art devices while avoiding the detriments individually associated therewith.

Further objects and advantages are to provide improved elements and arrangements thereof in an apparatus for the purposes described which is dependable, economical, durable and fully effective in accomplishing its intended purposes.

These and other objects and advantages are achieved in the apparatus for enhancing the performance of a sprinkler assembly or the like with which it is utilized, and wherein in the preferred embodiment a frame is slidably borne on a spring-biased sleeve which mounts the sprinkler assembly, the frame mounting a spring-biased pluger which is operable selectively to release fluid to the sprinkler assembly when the sprinkler assembly is positioned in a predetermined attitude above the surface of the earth.

DESCRIPTION OF THE PREFERRED EMBODIMENT

Figure 1:
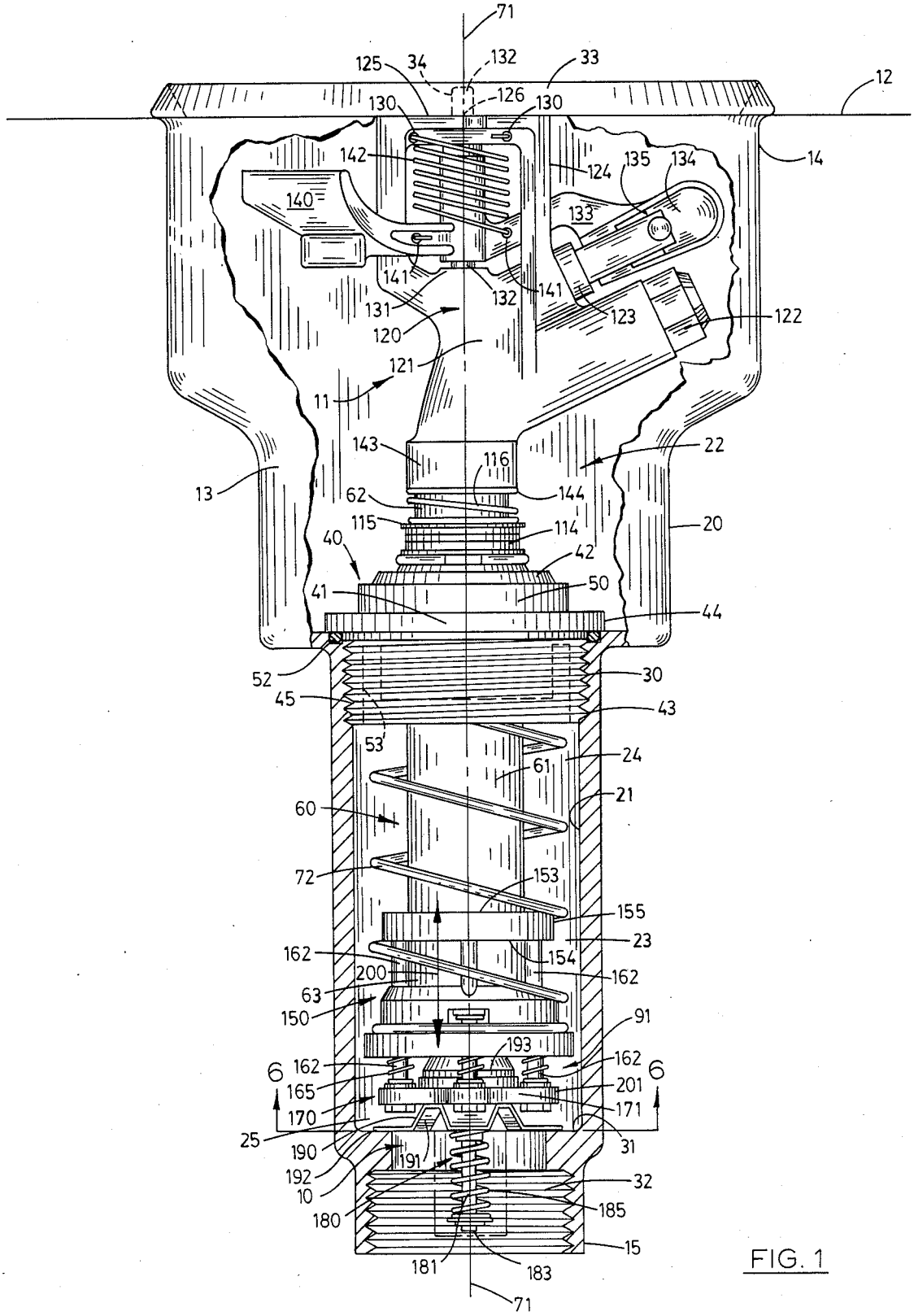
FIG. 1 is a fragmentary, longitudinal, vertical section of a sprinkler assembly on which the apparatus of the present invention is installed.

Referring more particularly to the drawings, the apparatus for enhancing the performance of a sprinkler assembly of the present invention is generally indicated by the numeral 10 in FIG. 1.

The apparatus as shown and described herein is illustrated in a typical operative environment where it is depicted as being employed in combination with a conventionally designed "pop-up" type impact head sprinkler assembly which is generally indicated by the numeral 11. The sprinkler assembly 11 is mounted below the surface of the earth 12 so as not to obstruct the surface for recreation or other purposes. The sprinkler assembly has a casing 13 which is connected in fluid transferring relation with a source of water, not shown. The casing has a first end 14; a second end 15, which is interconnected to the source of water; an outside surface 20; and an inside surface 21.

The inside surface 21 in close proximity to the first end 14 defines a first chamber 22 and the inside surface in close proximity to the second end 15 defines a second chamber or conduit generally indicated by the numeral 23. The conduit 23 has a proximal end 24, and a distal end 25. The inside surface in close proximity to the proximal end has formed therein a plurality of threads 30 which are adapted to receive a threaded collar which will hereinafter be discussed in greater detail. The distal end 25 defines a bottom or support surface 31 which has formed therein a threaded orifice 32 which is connected in fluid-flow relation with the source of water, not shown. A cover generally indicated by the numeral 33 is conformably dimensioned for mating receipt on and about the first end 14 of the casing 13. The cover, it should be understood, has formed therein an orifice 34 which allows the cover to be mounted to the sprinkler head 11 which will hereinafter be discussed in greater detail.

A threaded collar generally indicated by the numeral 40 is conformably dimensioned to be screw-threadably received in interlocking receipt with the plurality of threads 30 formed internally of the conduit 23. The collar 40 has a main body 41, a first end 42, and a second end 43. The main body further has an exterior surface 44 which has formed therein a plurality of threads 45 which are operable screw-threadably to engage the threads formed internally of the conduit 23, and an interior surface 46. A nut 50 is mounted to the first end of the collar. The nut provides the means by which the collar can be engaged by a suitable wrench, not shown. The first end of the collar defines a substantially annular flange 51, the annular flange is operable to capture an O-ring 52 in sealably secure mating relation thereagainst the inside surface 21 of the casing 13. Formed into the second end of the main body is a substantially circular spring seat 53 which is adapted to receive a retraction spring which will hereinafter be discussed in greater detail. Formed into and disposed substantially centrally of the main body 40 is an annular channel 54, which is defined by the interior surface 46. Formed into the annular channel 54 in close proximity to the first end 42 of the threaded collar 40 is a first annular seat 55. The first seat 55 is conformably dimensioned to receive a shaft wiping member 56 which is adapted to remove debris and other external contamination which may adhere to the spring-biased sleeve which will hereinafter be discussed in greater detail. Furthermore, the annular channel 54 has formed therein a second annular seat 57 which is conformably dimensioned to receive a substantially annular shaped lip seal 58. The lip seal is adapted to provide a water tight seal around the spring-biased sleeve.

The spring-biased sleeve 60 has a main body 61 which has a first end 62, a second end 63, an inside surface 64, and an outside surface 65. The inside surface 64 defines an elongated substantially cylindrical channel 70. The main body 61 also has a longitudinal axis generally indicated by the line labelled 71. Slidably received about the outside surface 65 of the main body 61 is a retraction spring 72 of predetermined dimensions. The retraction spring, it should be understood, positively retracts the sprinkler head back into the casing 13 when irrigation operations cease. The sprinkler head will hereinafter be discussed in greater detail.

Figure 3:
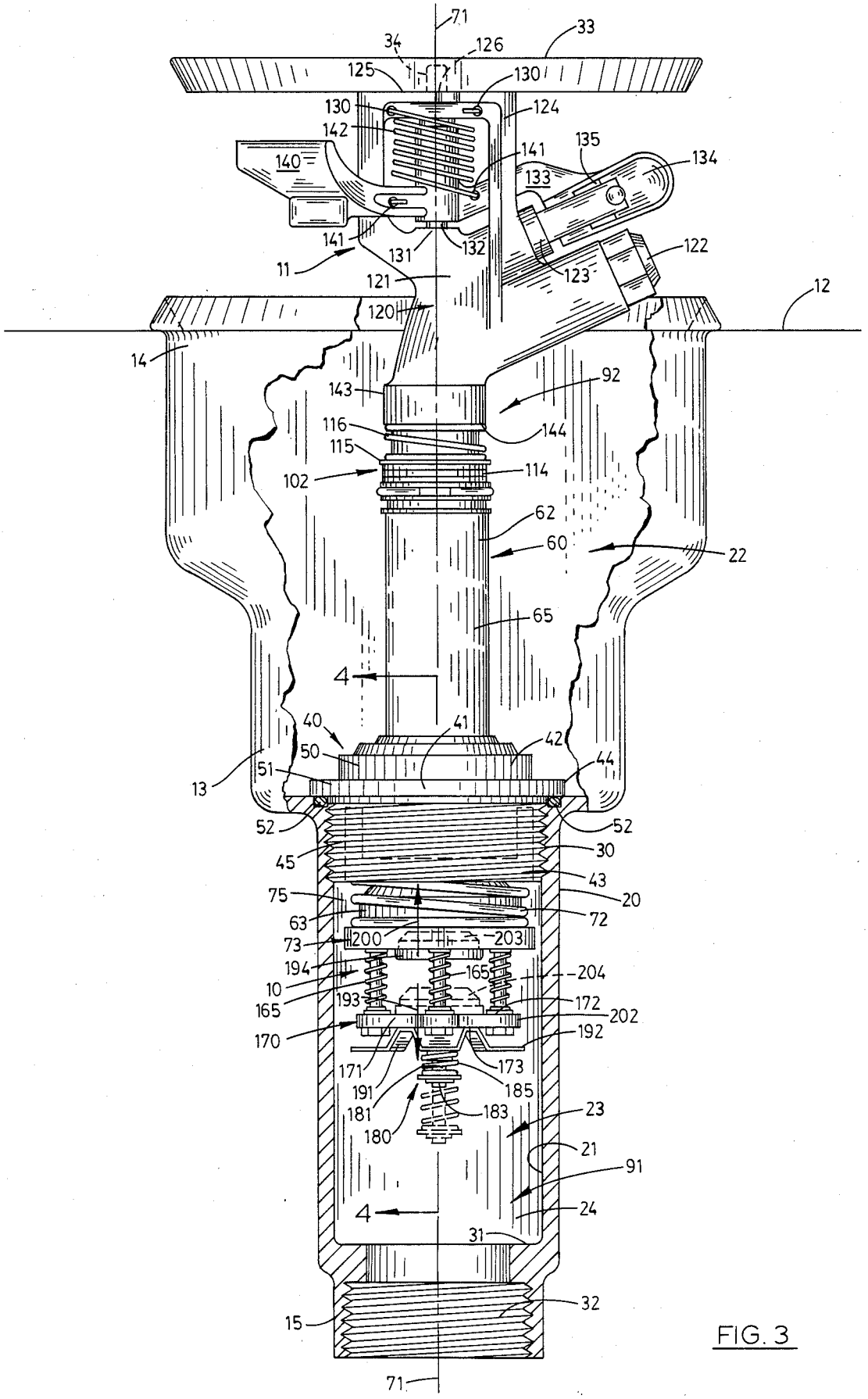
FIG. 3 is a fragmentary, longitudinal, vertical section of the sprinkler assembly of FIG. 1 in a fully deployed position.
Figure 4:
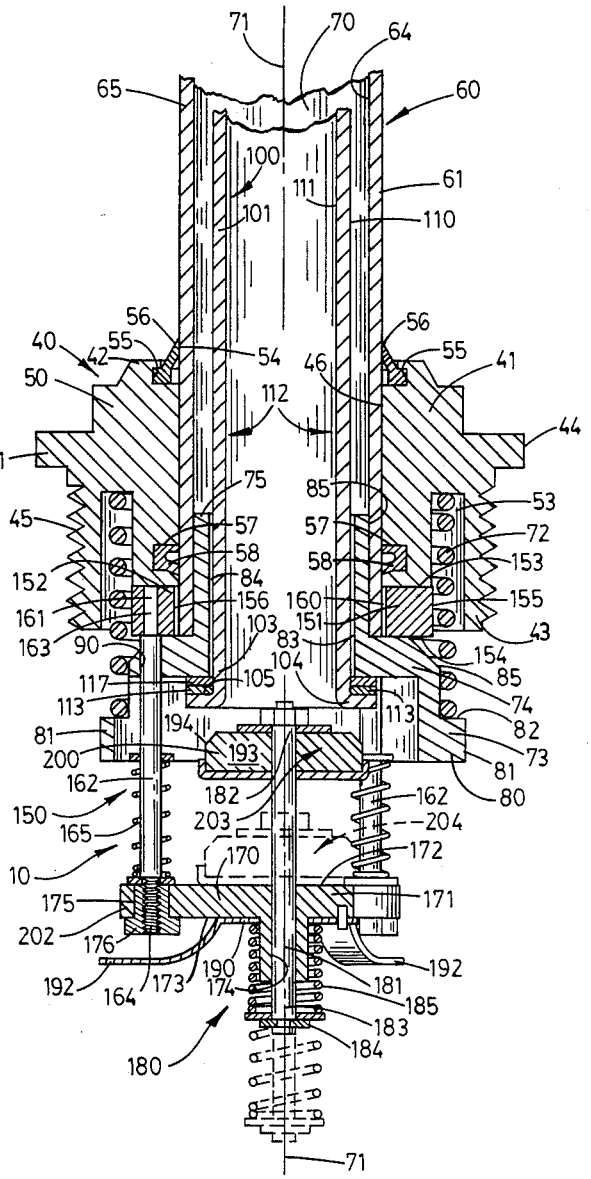
FIG. 4 is a somewhat enlarged fragmentary, longitudinal section taken from a position indicated by line 4—4 in FIG. 3.
Figure 6:
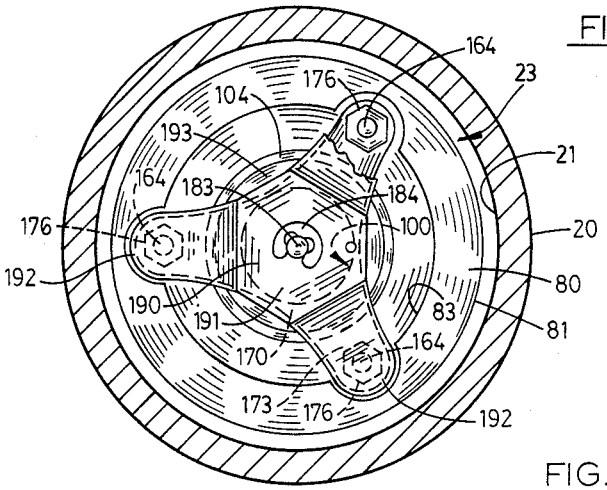
FIG. 6 is a somewhat enlarged transverse section taken from a position indicated by line 6—6 in FIG. 1.

A spring retaining sleeve 73 is mounted slidably in a substantially telescoping attitude internally of the cylindrical channel 70 at the second end 63 of the main body 61. The spring retaining sleeve has a thickened mid portion 74; a proximal end 75, which is substantially cylindrical in shape and which is received slidably in the cylindrical channel 70; and a distal end 80 which defines a flange 81 having a supporting surface 82. The supporting surface 82 engages the retraction spring 72 which is received slidably in the spring seat 53. The spring retaining sleeve has an inside surface 83 which defines a void 84. The spring retaining sleeve further has an outside surface 85 which has formed therein three substantially longitudinally disposed channels 90 only one of which is shown in FIG. 4. Each of the channels 90 receives slidably an individual post which will hereinafter be described in greater detail. As best understood by reference to FIG. 1, the spring-biased sleeve is operable, under the effect of fluid pressure introduced into the sprinkler system, not shown, to move from a position of rest 91, where it is disposed substantially internally of the conduit 23 to a deployed position 92 where it is positioned substantially externally of the conduit 23, the spring-biased sleeve positioning the sprinkler head in a predetermined position above the surface of the earth 12. The deployed position is best illustrated by reference to FIG. 3. The sprinkler head will hereinafter be discussed in greater detail.

Figure 5:
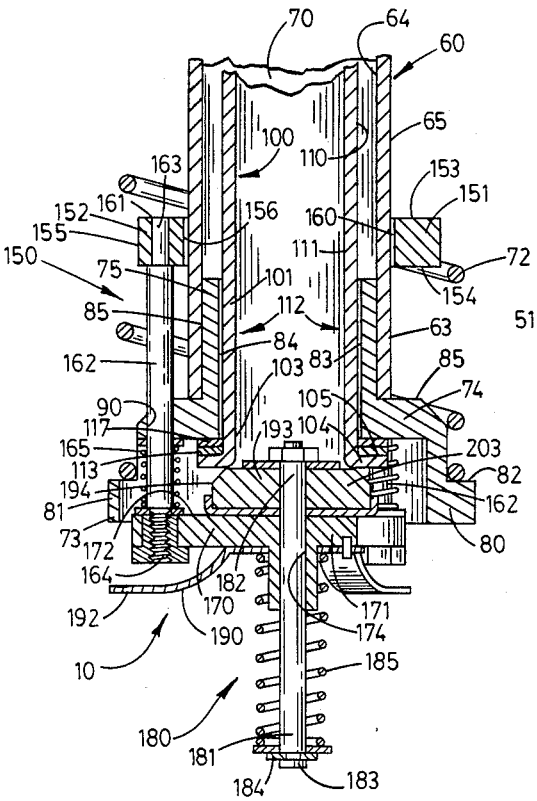
FIG. 5 is a somewhat enlarged, fragmentary, longitudinal section taken from a position indicated by line 5—5 in FIG. 2.

A spindle 100 is received slidably in a telescoping attitude internally of the void 84 defined by the inside surface 83 of the spring retaining sleeve 73. The spindle has a main body 101 which has a first end 102, and a second end 103. The second end 103 mounts a flange 104 defining a supporting surface 105. The main body 101 has an outside surface 110, and an inside surface 111 which defines a restricted diameter conduit 112. The supporting surface 105 mounts a lower bearing seal 113 which is operable to engage the inside surface 83 of the spring retaining sleeve 73 in sealably secure mating relation. This is best seen by reference to FIGS. 4 and 5. Furthermore, a top bearing seal 114, thrust washer 115, and bearing spring 116 are slidably mounted on and about the first end 102. A wear ring 117 is further mounted on the supporting surface 105 of the flange 104.

A sprinkler head generally indicated by the numeral 120 is screw-threadably mounted on the first end 102 of the spindle 100. As best seen by reference to FIG. 1, the sprinkler head has a main body 121 which has formed therein a water passage, not shown. The water passage screw-threadably mounts a suitably dimensioned spray nozzle 122 and a drive nozzle 123. A bridge 124 is mounted to the main body 121 of the sprinkler head 120. The bridge has a substantially horizontal top surface 125 which has formed therein an orifice 126. As should be understood, the top surface of the bridge also supports the cover 33. A pair of spring anchor points 130 are formed in the bridge, the spring anchor points are adapted to mount a drive spring which will hereinafter be discussed in greater detail. A pin seat, generally indicated by the numeral 131 is formed substantially centrally of the main body 121 and is disposed in substantial alignment with the orifice 126 formed in the bridge. The pin seat 131 is dimensioned slidably to receive a fulcrum pin 132, the fulcrum pin adapted pivotally to mount a drive lever 133 of conventional design. The fulcrum pin is also received slidably in the orifice 34 formed in the cover 33.

The drive lever 133 has a forward facing I-shaped member 134 which defines a channel 135. The drive lever further has a rearward facing impact area 140. As best seen by reference to FIG. 1, a pair of spring anchor points 141 are formed in the drive lever and are adapted to mount the drive spring 142. The main body 121 has a threaded neck 143 which is screw-threadably interconnected with the first end 102 of the spindle 100. The threaded neck 143 has a bottom edge 144, which is engaged by the bearing spring 116. As should be appreciated, the sprinkler head operates in a conventional manner, wherein water exiting from the drive nozzle 123 strikes the drive lever 133 causing it to swing away from the sprinkler head 120. When this event occurs, the drive spring 142 is placed under compression. The drive spring, after compression, thereafter urges the rearward facing impact area 140 of the drive lever 133 to strike the bridge 124. This repeated striking of the bridge causes the sprinkler head 120 to rotate about and irrigate the surrounding lawn in a substantially circular pattern.

Figure 2:
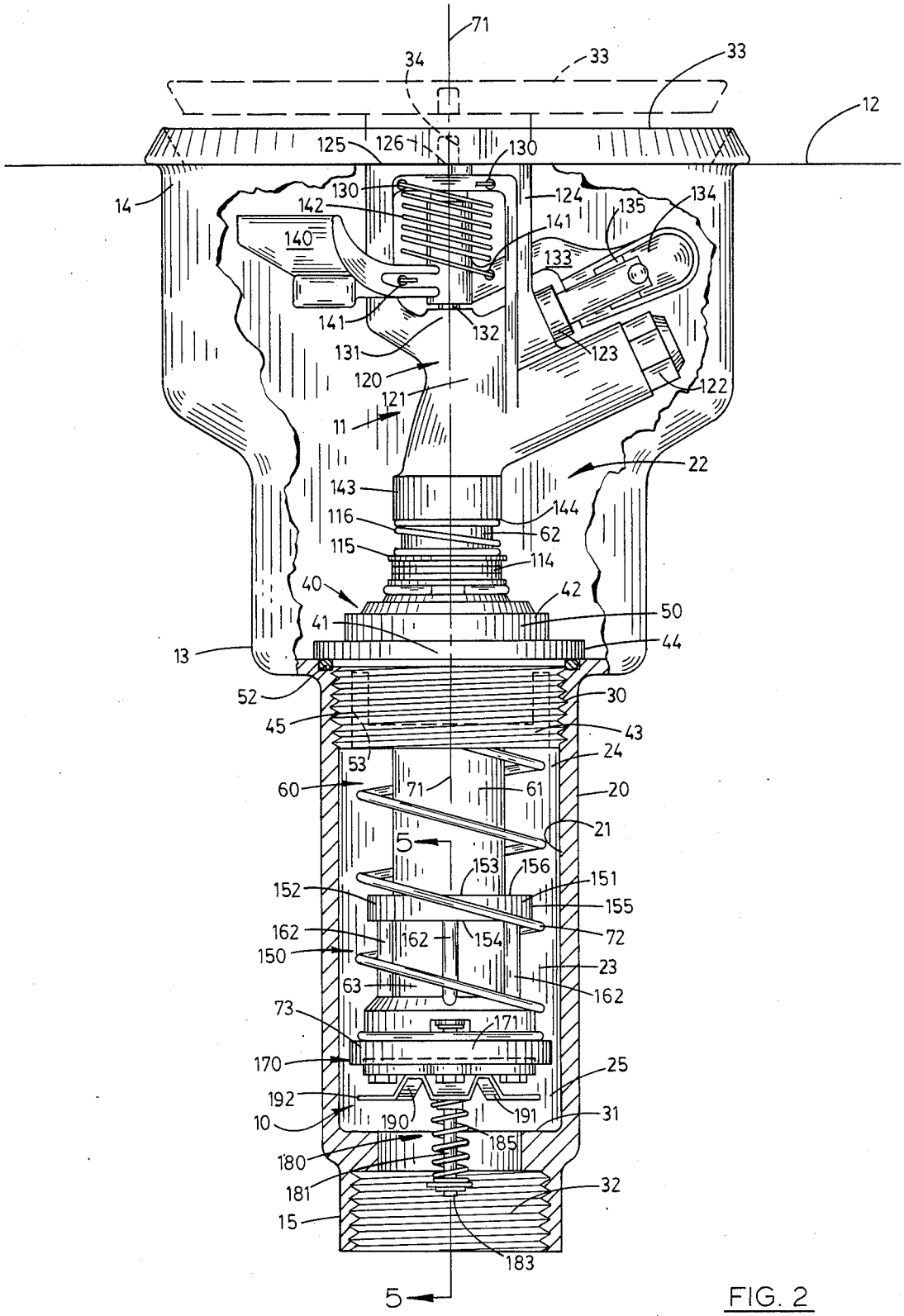
FIG. 2 is a fragmentary, longitudinal, vertical section of the sprinkler assembly of FIG. 1 in a partially deployed position.

As best seen by reference to FIG. 2, a frame, which is generally indicated by the numeral 150, is slidably mounted to the spring retaining sleeve 73. The frame has a first end piece 151, which has an annular shaped main body 152. The main body 152 further has a top surface 153, a bottom surface 154, an outside or peripheral edge 155, and an inside edge 156. The inside edge defines an orifice 160 which is conformably dimensioned slidably to receive the main body 61 of the spring-biased sleeve 60. Three mounting stations 161 are formed in substantially equidistant positions along the main body 152. Each of the mounting stations receives an individual post 162 which depends from the main body 152 at a substantially normal attitude. Each of the posts 162 further have a reduced diameter first end 163, which is conformably dimensioned to be received in mating engagement with the mounting station 161 and a threaded second end 164. Each of the posts is adapted to mount a short biasing spring 165.

Each of the posts 162 is adapted to receive and mount a second end piece, which is generally indicated by the numeral 170. The second end piece 170 has a main body 171, a top surface 172, and a bottom surface 173. Formed substantially centrally of the second end piece is an orifice 174. Three post receiving stations 175 are formed into the main body 171 and are operable screw-threadably to receive the threaded second ends 164 of the posts 162. Three screw posts, generally indicated by the numeral 176 are slidably received in the post receiving stations and are adapted screw-threadably to mate with the threaded second ends 164 of the posts 162. The screw posts, of course, secure the second end piece in substantially fixed parallel spaced relationship with respect to the first end piece 151.

A spring-biased plunger, which is generally indicated by the numeral 180, has a central shaft 181 which is mounted slidably in the orifice 174 which is formed substantially centrally of the second end piece 170. The central shaft has a first end 182 and a second end 183, the second end is adapted to receive a retaining clip 184. A biasing spring 185 is mounted slidably on and about the central shaft. Furthermore, a finger spring 190 is mounted on the bottom surface 173 of the second end piece. The finger spring has a main body 191 and a distal end portion of angulated configuration 192. The plunger 184 has an annular shaped main body 193 which is secured on the first end 182 of the central shaft 181. The annular shaped main body 193 has a peripheral edge 194 which is conformably dimensioned sealably to mate with the restricted diameter conduit 112 that is defined by the inside surface 111 of the spindle 100.

As best seen by reference to FIG. 1, the frame 150 is operable to move along a path of travel 200, from a first position 201, wherein the second end piece 170 is juxtapositioned with respect to the spring retaining sleeve 73, to a second position 202 which is best illustrated by reference to FIG. 4, wherein the second end piece is disposed in spaced relation to the spring retaining sleeve. As should be understood, when the spring biased sleeve 60 is disposed in its position of rest 91, the finger spring 190 is operable to urge the frame 150 into the first position 201. In the first position, the spring-biased plunger 180 is disposed in a first occluding position 203. When the spring-biased sleeve is urged to the deployed position 92, the second end 43 of the threaded collar 40 engages the first end piece 151 and moves the frame 150 to the second position 202. This movement of the frame, along the path of travel 200, causes the biasing spring 185 to be placed under compression. The biasing spring eventually is placed under sufficient compression such that it can urge the annular shaped main body 192 of the plunger 180 to move to a second non-occluding position 204 which releases water to the sprinkler head 120. As should be appreciated the movement of the spring-biased plunger to the non-occluding position occurs substantially simultaneously with the positioning of the sprinkler head 120 a predetermined distance above the surface of the earth 12.

OPERATION

The operation of the described embodiment of the present invention is believed to be readily apparent and is briefly summarized at this point.

The apparatus 10 is mounted slidably about the second end 63 of a spring-biased sleeve 60. The spring-biased sleeve is operable, under the effect of fluid pressure introduced into the sprinkler system, not shown, to move from a position of rest 91 where it is disposed substantially internally of the casing 13 to a deployed position 92, where it is adapted to position the sprinkler head 120 a predetermined distance above the surface of the earth 12. When fluid pressure is introduced into the sprinkler system, the spring-biased plunger 180 is urged into and thereafter held in the first occluding position 203 and thereby sealably mates with the restricted diameter conduit 112 of the spindle 100. The movement of the spring-biased plunger to the first occluding position thus prevents any water from escaping from the sprinkler head 120 while the sprinkler head is disposed internally of the casing 13.

As the spring-biased sleeve 60 nears the deployed position 92, the top surface 153 of the first end piece 151 comes into contact with the threaded collar 40. When this event occurs the frame 150 begins to be urged along the path of travel 200, from the first position 201 to the second position 202. As should be appreciated, the effect of the fluid pressure in the conduit 23 retains the spring-biased plunger 180 in sealably secure mating relation with the spindle 100, and in the first occluding position 203. Therefore, as the frame 150 moves to the second position 202 the biasing spring 185 which is received about the central shaft 181 is placed under compression by the movement of the second end piece 170. When the spring-biased sleeve reaches the deployed position 92, that is, when the sprinkler head 120 is out of the casing 13 and positioned above the surface of the earth 12, the biasing spring has been placed under sufficient compression such that it can overcome the fluid pressure holding the spring biased plunger in the first occluding position and urge the spring biased plunger to the non-occluding position 204. When this event occurs, water can enter into the restricted diameter conduit and exit out through the sprinkler head 120. When irrigation operations cease, the retract spring 72, which was placed under compression when the spring-biased sleeve 60 moved to the deployed position, urges the spring-biased sleeve back to the position of rest 91 substantially internally of the casing. When the sleeve returns to the position of rest the finger spring 190 engages the support surface 31 and thus positions the spring-biased plunger in fluid sealing relation to the spindle. In this position, the spring-biased plunger is operable to prevent fluid in the sprinkler system from draining by the action of gravity from the highest areas of the system to the lowest areas of the system.

Therefore, the apparatus 10 for enhancing the performance of a sprinkler assembly or the like is adapted for installation on a wide variety of different pop-up type sprinkler assemblies and is adapted operatively to cooperate with the sprinkler assembly thereby achieving more efficient sprinkler assembly operation. The apparatus operates to insure full extension and full retraction of the sprinkler assembly and operates selectively to release fluid to the sprinkler assembly when the sprinkler assembly reaches a predetermined position above the earth surface. The apparatus is readily removable for maintenance after installation, can be manufactured as an existing assembly or readily retrofitted on preexisting assemblies, and can be constructed and installed at a nominal price when compared with prior art devices.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desired to secure by Letters Patent is:

1. An apparatus for enhancing the performance of a sprinkler assembly or the like, the sprinkler assembly having a spring-biased sleeve which mounts a sprinkler head and which is movable along a path of travel from a position of rest to a deployed position, the apparatus comprising:

a frame slidably borne by the spring-biased sleeve; and a plunger mounted on the frame selectively to occlude the spring-biased sleeve during movement of the sleeve to said deployed position and being urged to a non-occluding position when the sprinkler head reaches the deployed position selectively to release fluid to the sprinkler head to achieve enhanced sprinkler assembly operation.

2. An apparatus for enhancing the performance of a sprinkler assembly or the like, the apparatus selectively releasing fluid into a sleeve, having a longitudinal axis, which mounts the sprinkler assembly, the apparatus comprising:

a frame slidably borne by the sleeve and adapted to move in a substantially longitudinal path of travel along the sleeve from a first position to a second position;

a plunger slidably mounted on the frame disposed in fluid impeding relation with the sleeve when the frame is disposed in said first position; and a spring mounted on the plunger operable to urge the plunger out of fluid impeding relation with the sleeve when the frame is moved to said second position to achieve said selective release of fluid to the sprinkler assembly.

3. The apparatus of claim 2 wherein the frame has first and second end pieces mounted thereon in substantially parallel relation to each other and the sleeve mounts a means for guiding the frame along the path of travel from the first position to the second position.

4. The apparatus of claim 3 wherein the first end piece is dimensioned slidably to be received about the sleeve and the second end piece mounts the plunger in substantial registry with the longitudinal axis of the sleeve.

5. The apparatus of claim 4 wherein the first and second end pieces are joined together by a plurality of posts; and the means for guiding the frame along the path of travel is a flange which has formed therein a plurality of channels which are operable slidably to receive the posts.

6. The apparatus of claim 5 wherein the first position of the frame is defined when the second end piece is juxtapositioned with respect to the sleeve, and the second position of the frame is defined when the second end piece is disposed in spaced relation to the sleeve.

7. The apparatus of claim 6 wherein the sleeve is slidably received internally of a conduit, the sleeve adapted to be urged by fluid pressure from a position of rest, which is substantially internal of the conduit, to a deployed position which is substantially external of the conduit, and the conduit mounts a threaded collar which is operable to engage the first end piece of the frame when the conduit is urged by fluid pressure to the deployed position, the threaded collar urging the frame to move along the path of travel from the first position to the second position to achieve the selective release of fluid to the sprinkler assembly.

8. An apparatus for enhancing the performance of a sprinkler assembly or the like, the apparatus selectively releasing fluid to the sprinkler assembly, the sprinkler assembly having a spring-biased sleeve which is slidably mounted internally of a conduit and having a longitudinal axis and mounting a conventionally designed sprinkler head, the apparatus comprising:

a first end piece slidably borne by the sleeve and having a substantially annular main body which has an inside edge defining an orifice dimensioned slidably to receive the sleeve;

a plurality of posts mounted on the first end piece and depending from the main body at substantially normal attitudes;

a second end piece mounted to the plurality of posts having a main body which has formed therein an orifice which is disposed in substantial registry with the longitudinal axis of the sleeve;

a plunger slidably mounted in the orifice formed in the second end piece and having a substantially shaped body which is operable to occlude the sleeve and which is mounted on a central shaft; and a biasing spring slidably received on the central shaft and under compression urging the plunger from a first occluding position with respect to the sleeve to a second non-occluding position, the plunger in the second non-occluding position disposed in spaced relation to the sleeve, the biasing spring placed under compression by movement of the first and second end pieces along a predetermined path of travel.

9. The apparatus of claim 8 wherein the spring-biased sleeve is operable under the effect of fluid pressure to move from a position of rest where it is disposed substantially internally of the conduit to a deployed position substantially externally of the conduit, and the second end piece further mounts a finger spring which is operable to position the plunger in the first occluding position when the spring-biased sleeve is disposed in the position of rest.

10. The apparatus of claim 9 wherein the conduit is operable to receive fluid and, upon the introduction of fluid into the conduit, is adapted to hold the substantially annular body of the plunger in occluding relation with respect to the spring-biased sleeve, the introduction of fluid into the conduit further urging the spring-biased sleeve to move from the position of rest to the deployed position.

11. The apparatus of claim 10 wherein the conduit mounts a threaded collar which is operable to engage the first end piece intermediate of the position of rest and the deployed position, the movement of the spring-biased sleeve to the deployed position causing the biasing spring to be placed under compression, the biasing spring urging the plunger from the first occluding position to the second non-occluding position when the spring-biased sleeve reaches the deployed position to achieve the selective release of fluid to the sprinkler head.

* * * * *